United States Patent [19]

Linsenbigler

[11] Patent Number: 4,968,540

[45] Date of Patent: Nov. 6, 1990

[54] ADHESIVE SECUREMENT STRIP FOR BOWS AND GREETING CARDS

[76] Inventor: James G. Linsenbigler, 153 F Hague Blvd., Glenmont, N.Y. 12077

[21] Appl. No.: 280,432

[22] Filed: Dec. 6, 1988

[51] Int. Cl.[5] ..... D04D 7/10

[52] U.S. Cl. ..... 428/5; 40/124.1; 156/249; 206/806; 229/923; 428/40; 428/43

[58] Field of Search ..... 428/4, 5, 40, 43; 40/124.1; 206/806; 229/923; 156/249

[56] References Cited

U.S. PATENT DOCUMENTS

| | | | |
|---|---|---|---|
| 3,026,639 | 3/1962 | Lille | 40/124.1 |
| 3,850,293 | 11/1974 | Scaringi | 428/5 X |
| 3,922,407 | 11/1975 | Nimmo, Jr. et al. | 428/5 |
| 4,383,607 | 5/1983 | Lordahl et al. | 206/470 X |
| 4,430,843 | 2/1984 | Favale | 206/471 X |
| 4,584,219 | 4/1986 | Baartmans | 428/40 X |
| 4,605,577 | 8/1986 | Bowytz | 428/40 |
| 4,650,706 | 3/1987 | Emmel | 428/40 |
| 4,666,751 | 5/1987 | Pasquali et al. | 428/40 |
| 4,702,368 | 10/1987 | Jones | 206/461 X |
| 4,702,948 | 10/1987 | Sieber-Gadient | 428/161 X |

*Primary Examiner*—Henry F. Epstein

[57] ABSTRACT

An adhesive securement strip for securing bows and greeting cards or envelopes on a package is formed from an elongated rectangular stip having front and back surfaces coated with an adhesive. Each of the front and back surfaces is covered by a removable peel-off sheet. The strip is divided into three zones by two transversely extending longitudinally spaced perforation lines. A first zone adjacent one end of the strip is dimensioned for securement of a bow. A second zone on said strip, intermediate opposite ends of the strip, is dimensioned for securement of a smaller of two different standard sizes of greeting cards and envelopes. A third zone, disposed adjacent an opposite end of the strip is dimensioned, in conjunction with the second zone, for securement of a larger of two different standard sizes of greeting cards and envelopes. By removing the third zone at the perforation line, the strip may be utilized for securement of a bow and a smaller sized greeting card or envelope. The second zone may be separated from the first zone and utilized to secure the bow and greeting card at spaced locations on the package.

2 Claims, 3 Drawing Sheets

ADHESIVE SECUREMENT STRIP FOR BOWS AND GREETING CARDS

BACKGROUND OF THE INVENTION 1. Field of the Invention

The present invention relates to adhesive securement strips, and more particularly pertains to a new and improved adhesive securement strip for fixing bows and greeting cards on packages. Conventionally, individuals must use tape to hold the envelope or card on a present or package, or try to secure the envelope by pushing a corner under the bow. This usually results in dislodgement of both the bow and the envelope. The present invention overcomes these problems by providing a combined adhesive securement strip for bows and greeting cards or envelopes.

2. Description of the Prior Art

Various types of adhesive securement strips are known in the prior art. A typical example of such an adhesive securement strip is to be found in U.S. Pat. No. 4,584,219, which issued to H. Baartmans on Apr. 22, 1986. This patent discloses a label web having a plurality of spaced apart self-adhesive labels, each defined by a peripheral cut from a web of label material adhering to a web of a carrier material. U.S. Pat. No. 4,605,577, which issued to S. Bowytz on Aug. 12, 1986, discloses a double-faced adhesive tape including a strip of waxed or non-stick material folded to form a pocket in which a piece of double-faced tape having a hold tab at one end thereof is inserted such that the hold tab projects from the pocket. To apply the tape, the wrapper and projecting hold tab are positioned between two pieces of material that are intended to be wrapped together. A pull tab, connected to the wrapper, extends from between the two pieces of material. Pressure is then applied to the material surrounding the hold tab in order to retain the hold tab in position, and the pull tab is pulled away from the hold tab and tape. As a result, the non-stick wrapper is removed from the tape, leaving the double-faced tape and the attached hold tab in position between the two materials now taped together. U.S. Pat. No. 4,650,706, which issued to J. Emmel on Mar. 17, 1987, discloses a pad of tape strips of pressure sensitive tape with a tape tab on each tape strip which is progressively shorter along the tape strips to facilitate separation of the tape strips without separating more than one strip at a time. U.S. Pat. No. 4,666,751, which issued to J. Pasquali et al on May 19, 1987, discloses a self-adhesive material having an adhesive composition deposited thereon. The adhesive composition is such that the total surface on which the material is deposited is less than the surface area of the material. U.S. Pat. No. 4,702,948, which issued to P. Sieber-Gadient on Oct. 27, 1987, discloses a self-adhesive tape with two sided contact adhesive coating. The self-adhesive tape has two sides, one of which forms a bottom side at which a supporting or carrier fabric is only superficially covered by a contact adhesive coating. At the other side, which forms the top side, a contact adhesive coating uniformly covers the supporting or carrier fabric so as to essentially form a plane which uninterruptedly engages a separating paper layer.

While the above mentioned devices are suited for their intended usage, none of these devices disclose an adhesive securement strip for securing both a bow and a greeting card or envelope on a package. Additionally, none of the aforesaid devices disclose an adhesive securement strip with a plurality of separate zones separated by perforation lines, each dimensioned to secure a bow or a standard sized greeting card. Inasmuch as the art is relatively crowded with respect to these various types of adhesive securement strips, it can be appreciated that there is a continuing need for and interest in improvements to such adhesive securement strips, and in this respect, the present invention addresses this need and interest.

SUMMARY OF THE INVENTION

In view of the foregoing disadvantages inherent in the known types of adhesive securement strips now present in the prior art, the present invention provides an improved adhesive securement strip for bows and greeting cards. As such, the general purpose of the present invention, which will be described subsequently in greater detail, is to provide a new and improved adhesive securement strip for bows and greeting cards which has all the advantages of the prior art adhesive securement strips and none of the disadvantages.

To attain this, representative embodiments of the concepts of the present invention are illustrated in the drawings and make use of an elongated rectangular strip having front and back surfaces coated with an adhesive. Each of the front and back surfaces is covered by a removable peel-off sheet. The strip is divided into three zones by two transversely extending longitudinally spaced perforation lines. A first zone adjacent one of the strip is dimensioned for securement of a bow. A second zone on said strip, intermediate opposite ends of the strip is dimensioned for securement of a smaller of two different standard sizes of greeting cards and envelopes. A third zone, disposed adjacent an opposite end of the strip is dimensioned, in conjunction with the second zone, for securement of a larger of two different standard sizes of greeting cards and envelopes. By removing the third zone at the perforation line, the strip may be utilized for securement of a bow and a smaller sized greeting card and envelope. The second zone may be separated from the first zone and utilized to secure the bow and greeting card at spaced locations on the package.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adhesive securement strip for bows and greeting cards which has all the advantages of the prior art adhesive securement strips and none of the disadvantages.

It is another object of the present invention to provide a new and improved adhesive securement strip for bows and greeting cards which may be easily and efficiently manufactured and marketed.

It is a further object of the present invention to provide a new and improved adhesive securement strip for bows and greeting cards which is of a durable and reliable construction.

An even further object of the present invention is to provide a new and improved adhesive securement strip for bows and greeting cards which is susceptible of a low cost of manufacture with regard to both materials and labor, and which accordingly is then susceptible of low prices of sale to the consuming public, thereby making such adhesive securement strips economically available to the buying public.

Still yet another object of the present invention is to provide a new and improved adhesive securement strip for bows and greeting cards which provides in the apparatuses and methods of the prior art some of the advantages thereof, while simultaneously overcoming some of the disadvantages normally associated therewith.

Still another object of the present invention is to provide a new and improved adhesive securement strip for bows and greeting cards for efficiently and neatly securing a bow and a greeting card or envelope on a wrapped present or package.

Yet another object of the present invention is to provide a new and improved adhesive securement strip for bows and greeting cards which utilizes an elongated rectangular strip provided with a plurality of zones formed by spaced transversely extending perforation lines and dimensioned to secure a bow and two different standard sizes of greeting cards or envelopes.

Even still another object of the present invention is to provide a new and improved adhesive securement strip for bows and greeting cards for alternatively securing a bow and a greeting card or envelope in contiguous or spaced locations on a present or package.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
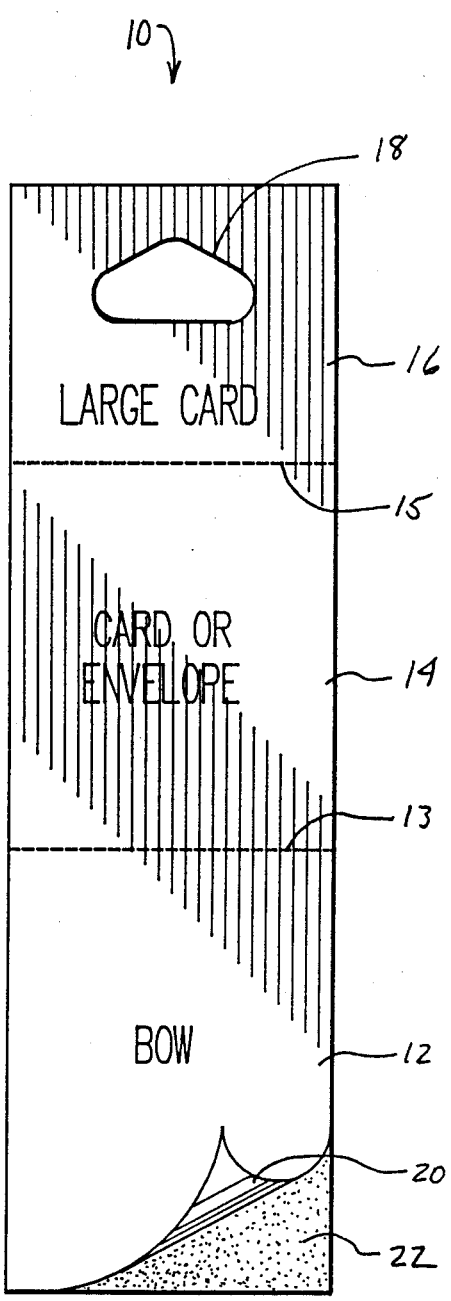
FIG. 1 is a top plan view of the adhesive securement strip according to a first embodiment of the present invention.

With reference now to the drawings, and in particular to FIG. 1 thereof, a new and improved adhesive securement strip for bows and greeting cards embodying the principles and concepts of the present invention and generally designated by the reference numeral 10 will be described.

More specifically, it will be noted that the first embodiment 10 of the invention includes an elongated generally rectangular strip divided into three zones 12, 14 and 16. The rectangular strip is preferably formed from a relatively rigid paper card stock material and has a front or upper surface 22 coated with an adhesive material covered by a removable peel-off sheet 20. The strip is divided by a pair of transversely extending longitudinally spaced perforation lines 13 and 15 into the three separate zones 12, 14 and 16. The first zone 12 is dimensioned to secure a bow on the upper surface 22, after removal of the peel-off sheet 20. The second zone 14 is dimensioned to secure a smaller of two different common standard sizes of greeting cards or envelopes. The third zone, situated adjacent the opposite end of the rectangular strip, is dimensioned, when combined with the extent of the second zone 14, to secure a second, larger standard sized of a greeting card or envelope. The rectangular strip is approximately 5 inches in length and preferably 1 ½ inches in width. The first zone 12 has a length of about 2 inches and the third zone 16 has a length of about 1 ¼ inches. The second or central zone 14 is about 1 ¾ inches in length. An aperture 18 is provided through the third zone 16, for purposes of displaying the article on a rack in a store. The upper surface 22 of the strip is preferably labeled to indicate the purpose of each of the three zones. For example, the zone 12 is labeled "BOW", the second zone 14 is labeled "CARD OR ENVELOPE" and the third zone 16 is labeled "LARGE CARD". The labeling is preferably provided on the surface 22, with the removable peel-off sheet 20 being of a transparent plastic material to allow an individual to read the labeling, prior to removal of the sheet 20.

Figure 2:
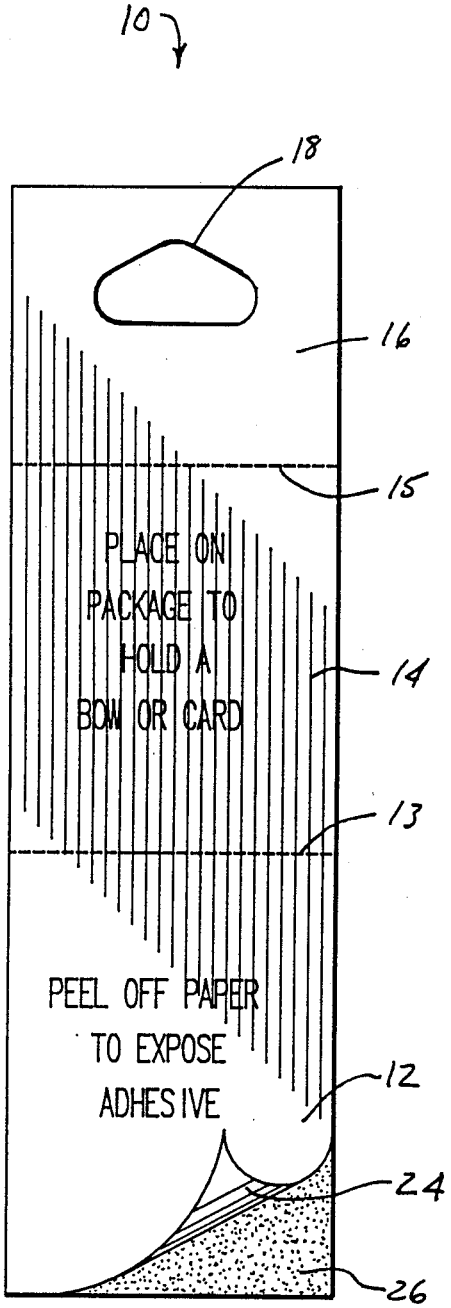
FIG. 2 is a bottom plan view of the adhesive securement strip of FIG. 1.

FIG. 2 provides a plan view of the back or opposite side of the rectangular strip. The back surface 26 is coated with an adhesive material and covered by a removable peel-off sheet 24. The back surface 26 of the first zone 12 is labeled "PEEL-OFF PAPER TO EXPOSE ADHESIVE", the back surface of the central or second zone 14 may be labeled "PLACE ON PACKAGE TO HOLD A BOW 0R CARD", to indicate the manner of using the device. In use, the sheet 24 is removed from the back adhesive surface 26 of the strip and the strip is secured at the intended location on a package. The third zone 16 may be removed if a smaller sized card or envelope is to be secured on the second zone 14, or left in place to utilize the combined extent of the second 14 and third zone 16 to secure a larger card or envelope. A bow may be secured on the first zone 12, after removal of the peel-off sheet 20. If it is desired to secure the bow and greeting card or envelope at spaced locations on the package, the first zone 12 may be separated from the second and third zones 14 and 16 by tearing along the perforation line 13.

Figure 3:
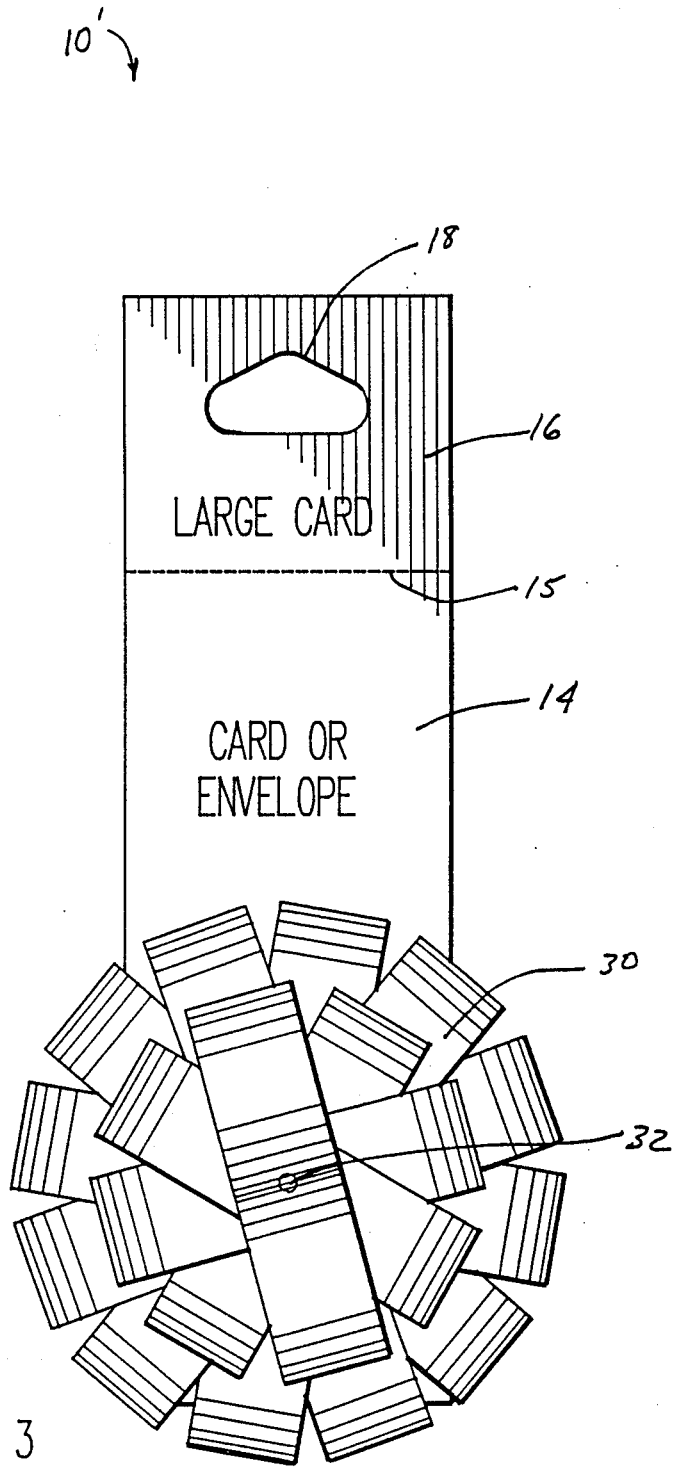
FIG. 3 is a top plan view illustrating an adhesive securement strip with a bow, according to a second embodiment of the present invention.

FIG. 3 provides a top plan view which illustrates a slightly modified second embodiment 10' of the present invention. The second embodiment is identically formed as described with reference to FIGS. 1 and 2, with the exception that a bow 30 is permanently secured on the first zone by a rivet fastener 32.

Figure 4:
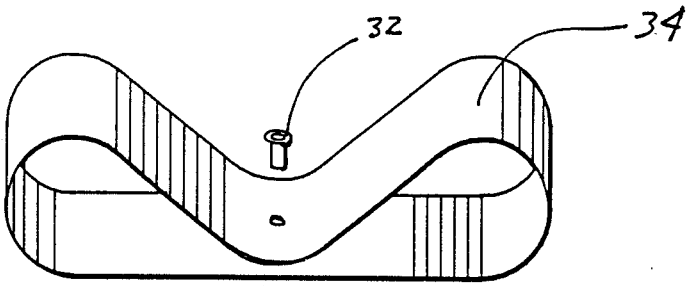
FIG. 4 is a perspective view illustrating the manner of mounting the bow on the adhesive securement strip.

FIG. 4 is a perspective view which illustrates the rivet fastener 32 utilized to secure a ribbon loop 34.

Figure 5:
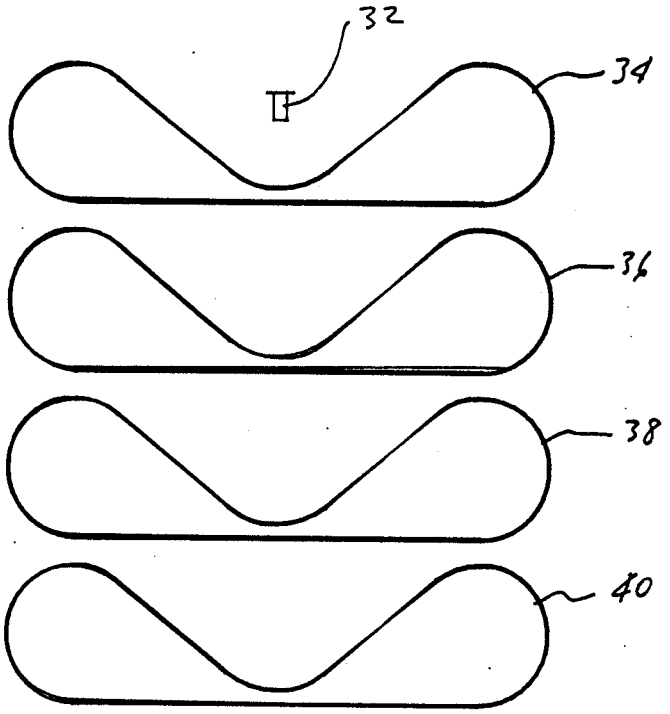
FIG. 5 is a side view which further illustrates the manner of forming the bow.

FIG. 5 provides a side view which further illustrates the manner of forming the bow from a plurality of discreet ribbon loops 34, 36, 38 and 40 through the use of the rivet fastener.

As may now be understood, the present invention provides an adhesive securement strip which facilitates the efficient application of bows and greeting cards or envelopes to a wrapped package or present, without requiring the manipulation of tape or scissors. The device allows the individual to select large or small standard sizes of greeting cards and also to situate the bow and greeting card or envelope at contiguous or spaced apart locations on the package.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An adhesive securement strip for bows and greeting cards, for use in wrapping presents, comprising:

an elongated rectangular strip;

said strip having front and back surfaces each coated with an adhesive and each covered by a transparent removable peel-off sheet;

said strip divided into three zones by a pair of spaced transversely extending perforation lines;

a first zone formed adjacent one end portion of said strip dimensioned for securement of a bow;

a second zone formed intermediate opposite ends of said strip dimensioned for securement of a smaller of two different standard sizes of greeting cards or envelopes;

a third zone formed adjacent an opposite end of said strip dimensioned, in conjunction with said second zone, for securement of a larger of two different standard sizes of greeting cards or envelopes;

a bow secured on said first zone;

an aperture formed through said third zone for displaying said strip on a rack; and indicia defining and designating usage of each of said zones provided on both said front and back surfaces, beneath said transparent peel off strips.

2. A method for securing a bow and a greeting card to a package, comprising the steps of:

providing an elongated rectangular strip, said strip having front and back surfaces each coated with an adhesive and each covered by a removable transparent peel-off sheet, said strip divided into three zones by a pair of spaced transversely extending perforation lines, a first zone formed adjacent one end portion of the strip dimensioned for securement of a bow, a second zone formed intermediate opposite ends of said strip dimensioned for securement of a smaller of two different standard sizes of greeting cards or envelopes, a third zone formed adjacent an opposite end of said strip dimensioned in conjunction with said second zone for securement of a larger of two different standard sizes of greeting cards or envelopes, a bow secured on said first zone, and indicia defining and designating usage of each of said zones provided on both said front and back surfaces, beneath said transparent peel off strips;

removing said peel-off sheet from said back surface of said strip;

securing said strip on a package;

selecting a greeting card or envelope;

removing said third zone of said strip by tearing said zone at one of said perforation lines if said greeting card or envelope is smaller than or equal to the extent of said second zone;

removing said peel-off sheet from said front surface of said strip; and securing said greeting card or envelope on said second or on said second third zones.

* * * * *